US006788264B2

(12) United States Patent
Du

(10) Patent No.: US 6,788,264 B2
(45) Date of Patent: Sep. 7, 2004

(54) LOW PROFILE SATELLITE ANTENNA

(75) Inventor: Xin Du, Bartlett, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/172,915

(22) Filed: Jun. 17, 2002

(65) Prior Publication Data

US 2003/0231136 A1 Dec. 18, 2003

(51) Int. Cl.[7] ..... H01Q 21/00

(52) U.S. Cl. ..... 343/725; 343/700 MS; 343/726; 343/769; 343/895

(58) Field of Search ..... 343/725, 726, 343/795, 895, 728, 829, 846, 742, 769, 700 MS, 702, 872

(56) References Cited

U.S. PATENT DOCUMENTS

| | | | | | |
|---|---|---|---|---|---|
| 4,538,153 | A | | 8/1985 | Taga | |
| 4,554,549 | A | * | 11/1985 | Fassett et al. | 343/700 MS |
| 4,698,638 | A | * | 10/1987 | Branigan et al. | 343/725 |
| 4,821,040 | A | | 4/1989 | Johnson et al. | |
| 4,849,765 | A | | 7/1989 | Marko | |
| 5,521,610 | A | | 5/1996 | Rodal | |
| 6,002,359 | A | | 12/1999 | Chen | |
| 6,008,772 | A | * | 12/1999 | Legay et al. | 343/787 |
| 6,023,245 | A | * | 2/2000 | Gomez et al. | 343/725 |
| 6,064,347 | A | | 5/2000 | Fordham | |
| 6,218,995 | B1 | * | 4/2001 | Higgins et al. | 343/719 |
| 6,229,499 | B1 | | 5/2001 | Licul | |
| 6,292,141 | B1 | | 9/2001 | Lim | |
| 6,317,084 | B1 | | 11/2001 | Chen et al. | |
| 6,329,954 | B1 | * | 12/2001 | Fuchs et al. | 343/725 |

OTHER PUBLICATIONS

Nguyen, Anh; et al Glass–mountable antenna system with DC and RF coupling United States Patent Application Publication 2002/0008667, Jan. 24, 2002.

* cited by examiner

*Primary Examiner*—Tho Phan
(74) *Attorney, Agent, or Firm*—Babcock IP, LLC

(57) ABSTRACT

A satellite antenna with a radiator element arranged between a ring element and a ground plane. The radiator element arranged in a substantially parallel orientation and electrically isolated from the ring element and the ground plane. The antenna elements may be dimensioned for reception of SDAR frequency bands.

24 Claims, 7 Drawing Sheets

LOW PROFILE SATELLITE ANTENNA

BACKGROUND OF THE INVENTION

1. Field of the Invention

The invention relates to satellite antennas. More specifically, the invention relates to an inexpensive to manufacture, for example, Satellite Digital Audio Radio (SDAR) antenna having a low profile, for example, suitable for mounting on a motor vehicle.

2. Description of Related Art

SDAR is a form of digital satellite radio, currently offered on a subscription basis by XM and Sirius. SDAR receives in the S-Band frequency range (2.3 Gigahertz Band) with upper hemisphere coverage. To provide reception in urban environments where satellite line of sight signals may be blocked by earth contours, buildings and/or vegetation SDAR uses both satellite and terrestrial mounted transmitters and therefore requires antennas with vertical radiation patterns (satellite) as well as improved low angle performance (terrestrial). XM specifies antenna performance of 2 dBic over a range of 25–60 degrees elevation. Sirius specifies antenna performance of 3 dBic over 25–75 degrees elevation and 2 dBic over 75–90 degrees elevation.

Prior SDAR antennas have used a left hand circular polarized quadrifilar antenna element configuration. Another antenna element configuration used with SDAR is the curved cross dipole configuration. Both types of antenna structures have antenna element vertical heights of over one inch.

SDAR is beginning to have wide use in consumer vehicles where a minimized antenna profile is preferred. Low profile antennas increase resistance to accidental breakage from, for example, automated car washes and tree limbs. Less visually noticeable from a distance, low profile antennas also reduce vandalism and theft opportunities. Also, negative effects on aerodynamics and disruption of vehicle design aesthetics are minimized.

Competition within the antenna industry has also focused attention on minimization of materials and manufacturing process costs.

Circular microstrip antennas have a fundamental TM11 excitation mode with a relatively narrow beam. Circular microstrip antennas have been used for satellite reception where an upper hemisphere radiation pattern with poor low angle coverage is acceptable, for example with Global Positioning Satellites (GPS). Circular microstrip antenna designs are inexpensive, durable and have an extremely low profile. Microstrip antennas may be configured to operate in a TM21 higher order mode that creates a conical radiation pattern with a null at center/vertical, useful for receiving low angle terrestrial originated signals.

Therefore, it is an object of the invention to provide an antenna, which overcomes deficiencies in the prior art.

DETAILED DESCRIPTION

Figure 1A:
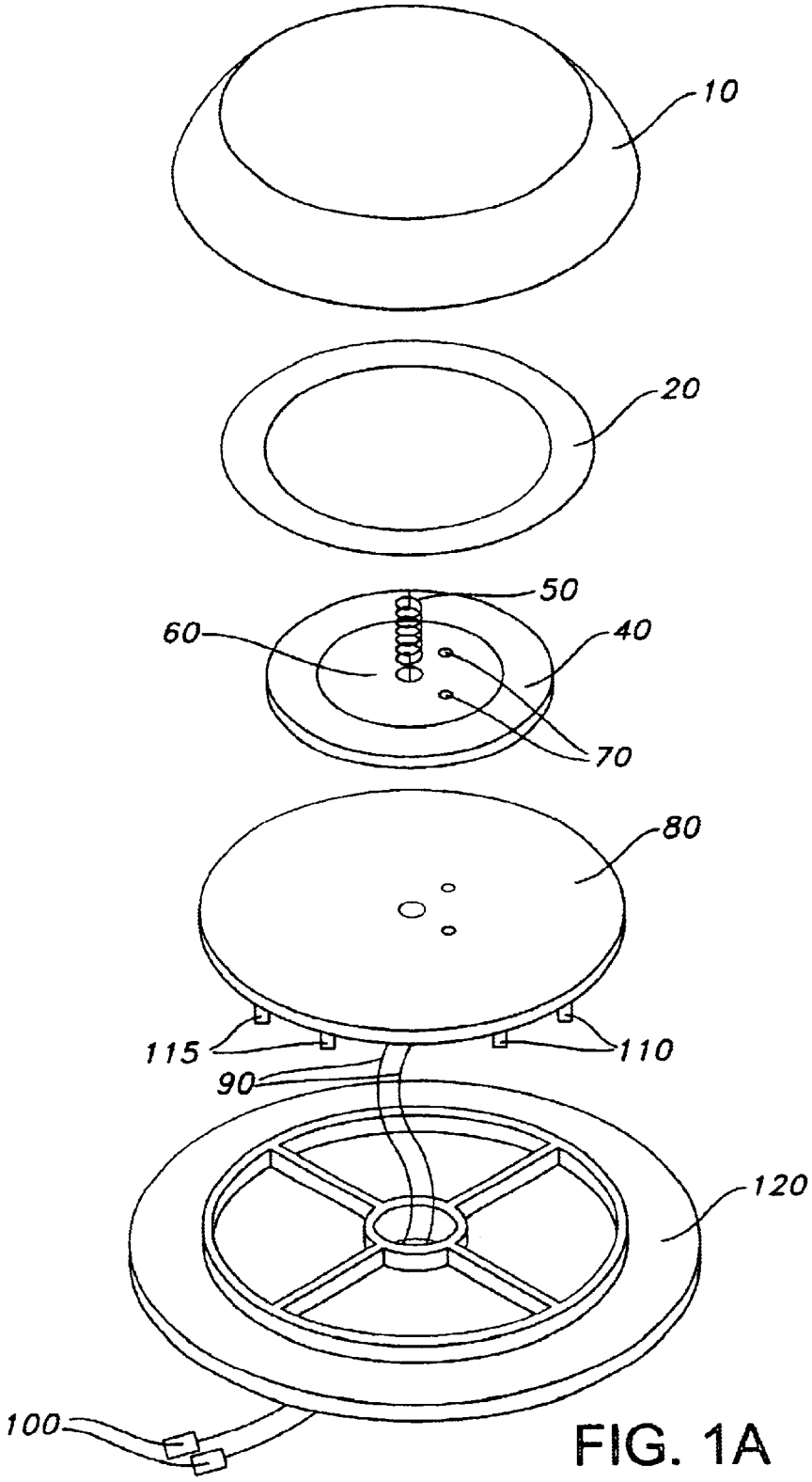
FIG. 1*a* shows an exploded isometric view of a first embodiment of the invention.
Figure 1B:
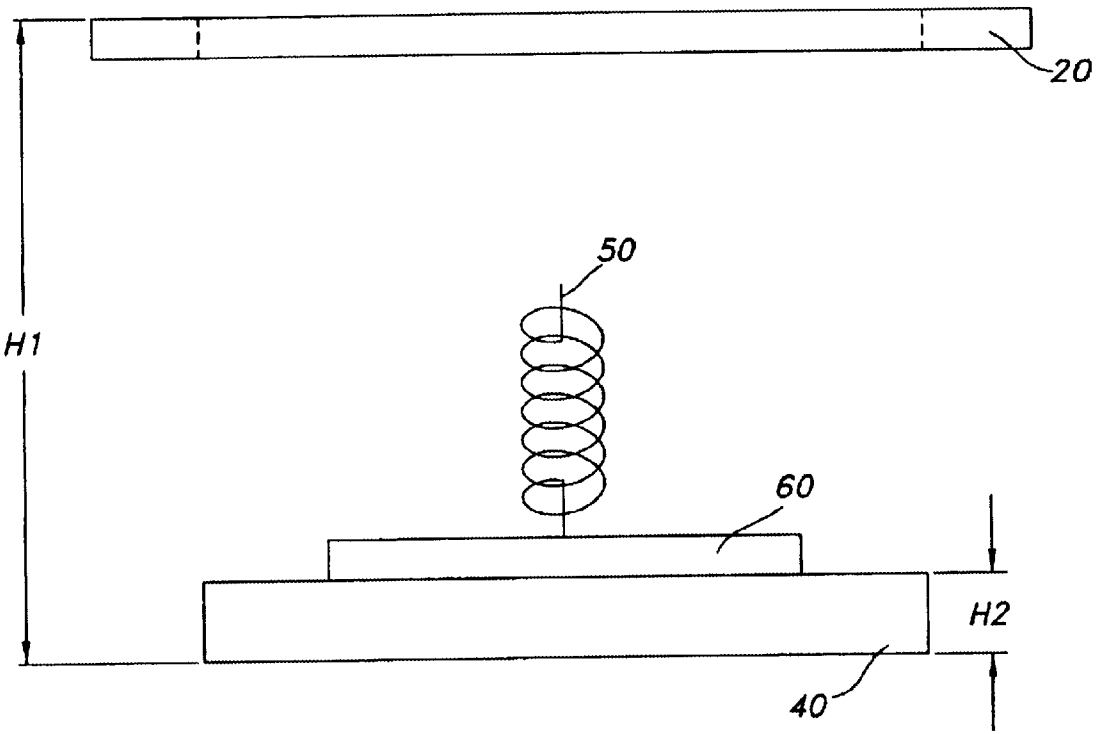
FIG. 1*b* shows a side view of antenna elements of a first embodiment of the invention.
Figure 1C:
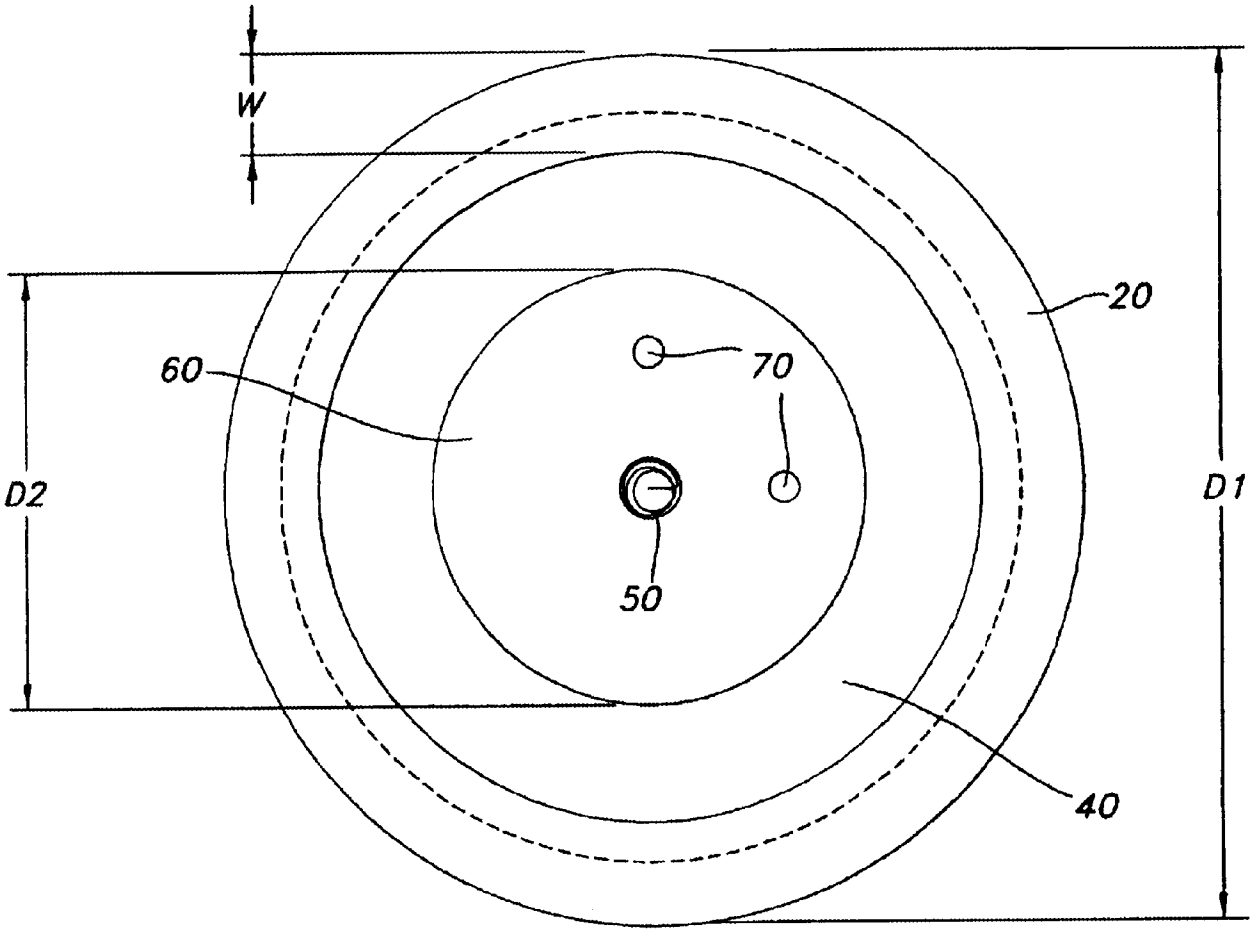
FIG. 1*c* shows a top view of antenna elements of a first embodiment of the invention.

A first embodiment, shown in FIGS. 1*a*–1*c*, has a cover 10 that mates to a base plate 120. The base plate 120 may be metal or metal alloy, formed for example, by die-casting. The cover 10 may be formed, for example, by injection molding using a RF transmissive insulating material, such as polycarbonate, acrylic or other plastic material. The cover 10 may be shaped to create an environmental seal against the base plate 120, isolating the antenna elements and circuitry from water and other contaminant infiltration. Application of a sealing adhesive and/or a gasket (not shown) aids the environmental seal integrity.

A printed circuit board (PCB) 80 which may contain electrical components 110 on its underside, e.g., at least one low noise amplifier and/or tuning/filter circuitry has a ground plane trace which mates with contact points of the base plate 120 creating a common ground plane for the antenna which extends through the base plate 120 to a vehicle body upon which the antenna may be mountable. Antenna leads 90, for example shielded co-axial cable, for SDAR-satellite and SDAR-terrestrial may be attached to dedicated low noise antenna amplifiers fed via 90 degree hybrid couplers 115 on the PCB 80. The leads 90 may be routed through a hole 130 in the base plate 120 for connection to a vehicle SDAR receiver antenna inputs wire harness via coaxial connectors 100.

An insulator 40 may be located on a top side of the PCB 80. As shown in FIG. 1*b*, the insulator 40 may be formed from a dielectric substrate and has a thickness H2, of at least 3 millimeters, for example, 3.175 millimeters. Suitable materials for insulator 40 include, for example, polystyrene, polyphenolic oxide or other, for example, low cost materials with a suitable dielectric constant in the range of about 2–10. A, for example, circular shaped radiator element 60, having a diameter D2 (FIG. 1*c*) of, for example, 40 millimeters, attached to the insulator 40, receives SDAR-satellite signals. The radiator element 60 has two feeds 70 through the insulator 40 coupled to the PCB 80. The feeds 70 may be physically arranged at 90 degrees to each other with respect to a center of the radiator element 60.

SDAR-terrestrial signals are received by a vertical coil 50 arranged in a substantially tangential orientation with respect to and interconnected with PCB 80 which extends, isolated from the radiator element 60, through a center hole in the radiator element 60 and insulator 40. The vertical coil 50 may be configured for vertical polarization.

A ring element 20, for example, circular with a width WI of 7 millimeters and an outer diameter D1 of 48 millimeters, may be formed as a separate conductor ring element or as a ring conductive layer 21 (FIG. 2) on a PCB board or other insulator. The ring element 20 or ring conductive layer 21 may be adhered to an aligning inside surface of the cover 10 or may be snap fit into a retaining structure molded into the inside surface of the cover 10. The mounting points of the ring element 20 or ring conductive layer to the inside surface of the cover 10 may be arranged whereby the ring element 20 or ring conductive layer is substantially parallel to the PCB 80 at a height H1 (FIG. 1*b*) from the ground plane of the PCB 80 of approximately 11 millimeters. The ring element 20 or ring conductive layer may be positioned concentric with the radiator element 60.

The height H1 may be selected to be less than one quarter of the wavelength of the target frequency. The height H1, in combination with the ring element width W and outer diameter D1 (FIG. 1*c*) dimensions are may be selected to create a level of higher mode excitation and thereby tune the resulting beam width.

The initial dimensions of the antenna elements may be calculated using cavity model calculations even though the height H1 exceeds the generally accepted valid range for the cavity model. Further adaptation may be made by using commercial structure simulation software using method of moment functionality, for example IE3D by Zeland Inc. of Fremont, Calif., USA.

Variations of the first and the following embodiments may include dimensional changes of the elements and their positions with respect to each other. For example, the ring element 20 may have a narrower width W if the ring element 20 height H1 is increased.

Figure 2:
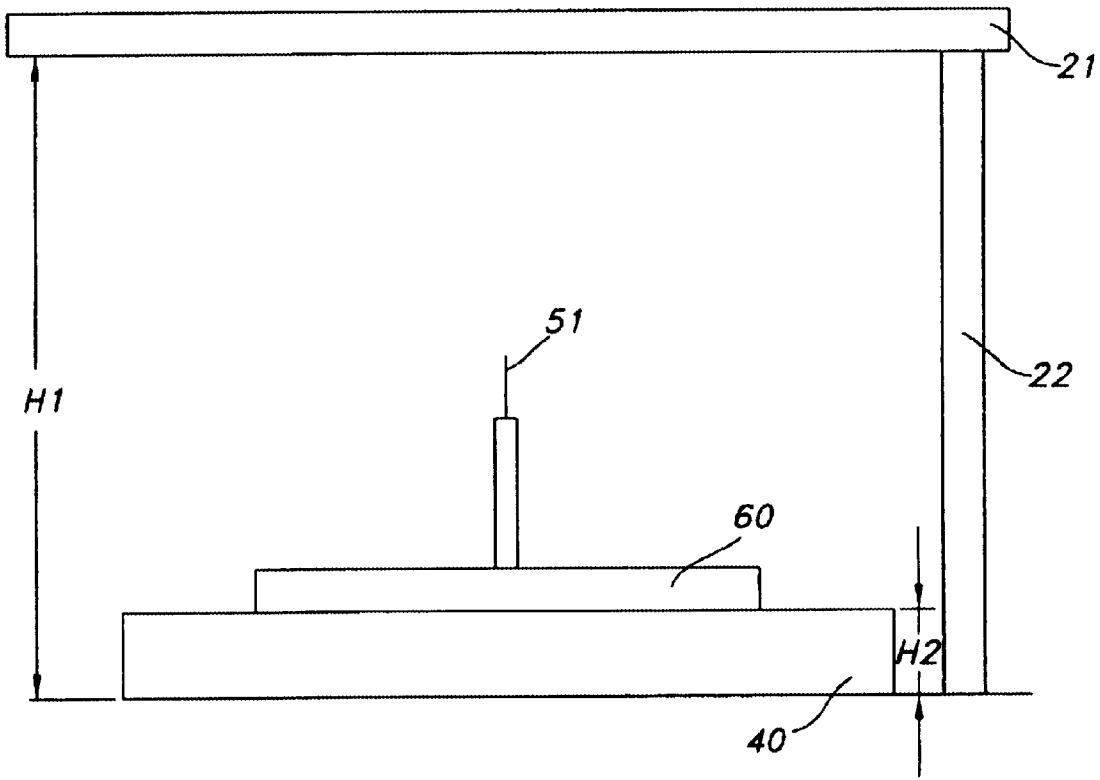
FIG. 2 shows a side view of antenna elements of a second embodiment of the invention.

Further embodiments of the invention may utilize different SDAR-terrestrial antenna elements. For example, as shown in FIG. 2, the SDAR-terrestrial antenna element may be a sleeve dipole 51 resulting in higher antenna gain. Further, rather than being attached to the cover 10, the ring element may be held in position via at least one post 22, formed from an insulating material and attached to, for example, the PCB 80 or the insulator 40. Alternatively, the insulator 40 may have one or more post(s) 22 integrated into a singe component.

Figure 3:
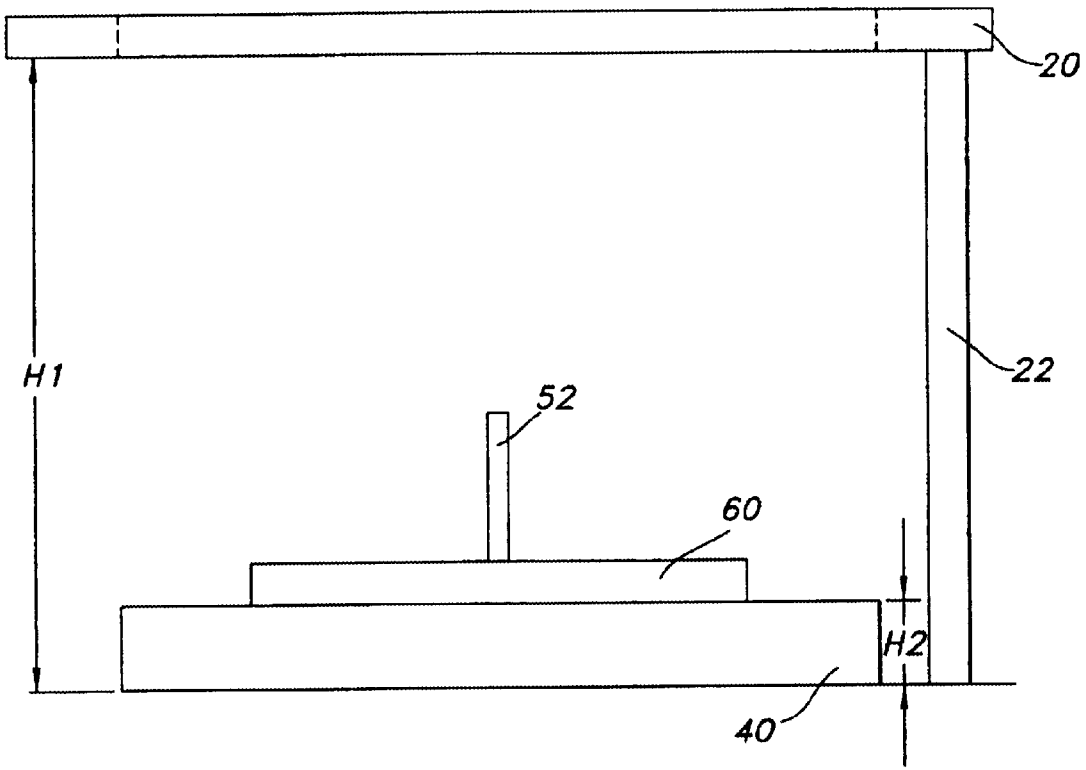
FIG. 3 shows a side view of antenna elements of a third embodiment of the invention.
Figure 4:
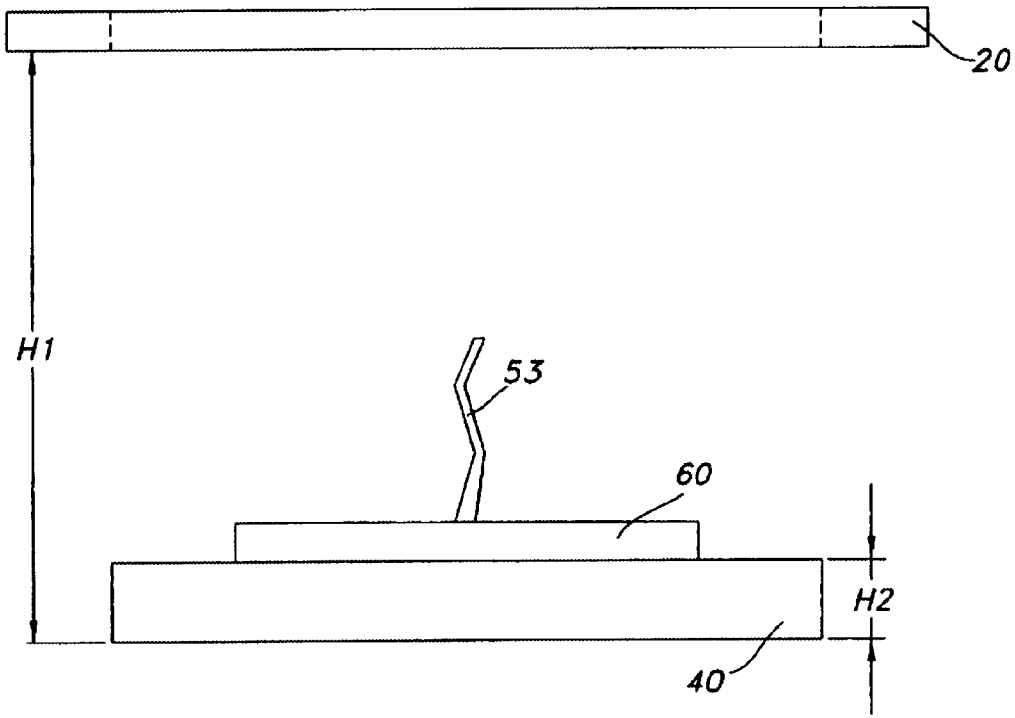
FIG. 4 shows a side view of antenna elements of a fourth embodiment of the invention.

Alternatively, as shown in FIGS. 3 and 4, the SDAR-terrestrial antenna may be a rod 52 or helix 53. Further, the feeds 70 may be increased to four connections arranged orthogonally, that is with 90 degree separation, with respect to a center of the radiator element 60. Increasing the number of feeds 70 to four increases the uniformity of the antenna response pattern by minimizing pattern tilt but causes a slight increase in manufacturing costs.

Figure 5:
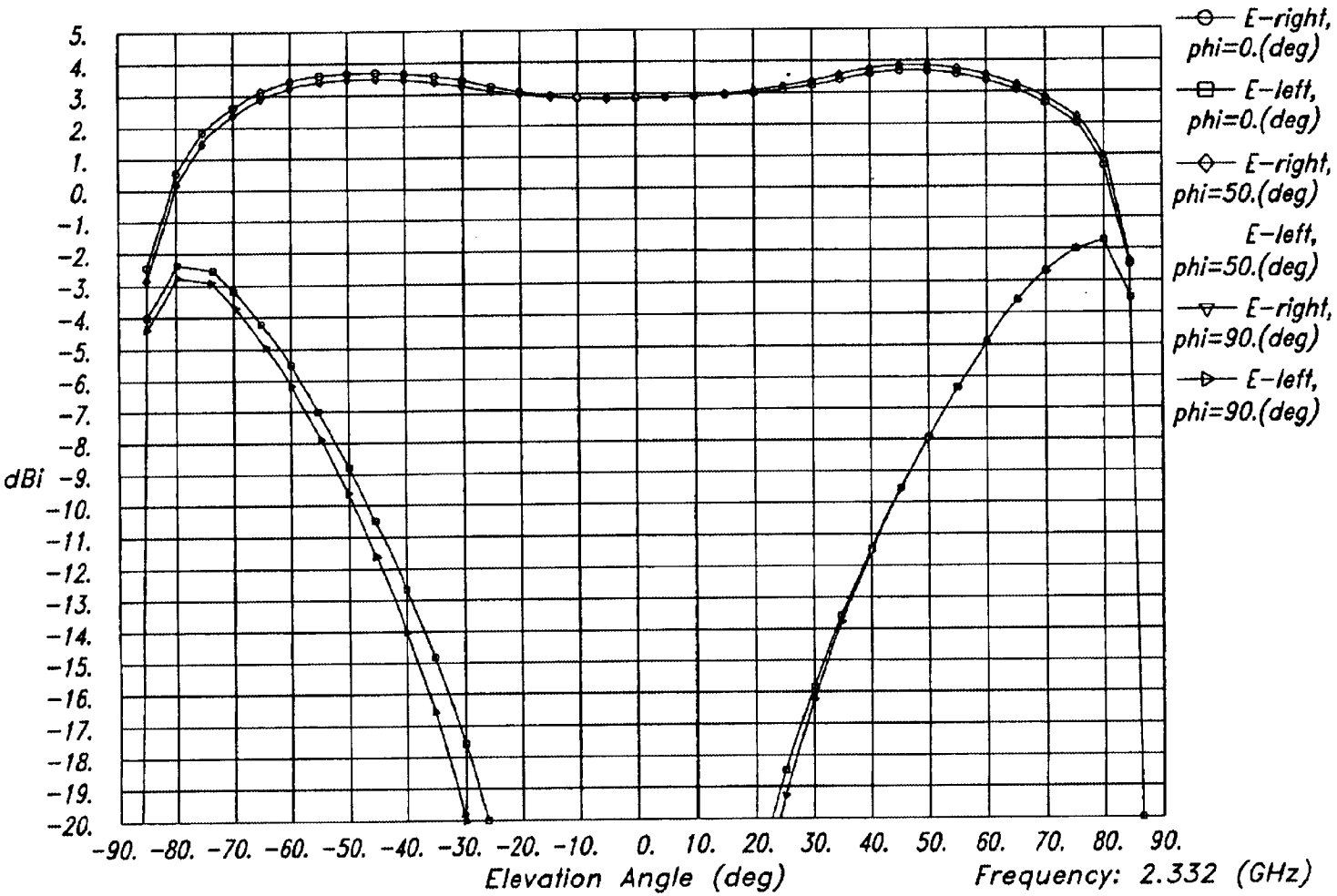
FIG. 5 shows test performance data of the first embodiment.

As demonstrated by elevation angle test data shown in FIG. 5, the ring element 20 has a beneficial effect on the reception field of the radiator element 60. Acting as a parasitic element, the ring element 20 disturbs the field received by the radiator element 60 to a different resonant level (perturbation), creating a mixed (higher) mode. As a result, the previously poor low angle coverage of a TM11 mode radiator element 60 may be improved to a level that satisfies SDAR antenna requirements.

As described, the SDAR antenna provides the following advantages. The antenna elements may be formed with a minimal size, for example a diameter of approximately 58 millimeters and a height of approximately 11 millimeters. Because all of the parts, except the vertical coil 50, may be substantially interconnected, the resulting antenna has improved vibration and impact resistance. Use of printed circuit technology decreases component costs and increases final manufacturing assembly efficiency.

Table of Parts

| | |
|---|---|
| 10 | cover |
| 20 | ring |
| 21 | ring conductive layer |
| 22 | post |
| 40 | insulator |

-continued

Table of Parts

| | |
|---|---|
| 60 | radiator element |
| 70 | feed |
| 80 | printed circuit board |
| 90 | antenna lead |
| 100 | connector |
| 110 | electrical component |
| 115 | coupler |
| 120 | base plate |
| 130 | hole |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention if the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A satellite antenna, comprising:

a cover;

a ring element arranged in a substantially parallel orientation and electrically isolated from a first side of a radiator element;

a second side of the radiator element abutting an insulator;

the insulator abutting a printed circuit board having a ground plane conductive layer end a first low noise amplifier circuit and a second low noise amplifier circuit;

the printed circuit board abutting a base plate; and a terrestrial element electrically isolated from the radiator element;

the terrestrial element coupled with the first low noise amplifier circuit;

the radiator element coupled with the second low noise amplifier circuit;

the cover mating with the base plate, enclosing the ring element, the radiator element, the insulator and the printed circuit board.

2. The antenna of claim 1, wherein the ring element is attached to an underside of the cover.

3. The antenna or claim 1, wherein the ring element is supported by at least one post attached to the printed circuit board.

4. The antenna of claim 1, wherein the ring element is supported by at least one post attached to the insulator.

5. The antenna of claim 1, wherein the ring element is supported by at least one post molded as a single component with the insulator.

6. The antenna of claim 1, wherein the ring element is circular shaped.

7. The antenna of claim 1, wherein the ring element is formed from a conductor having a circular cross section.

8. The antenna of claim 1, wherein the ring element is a conductive layer on a substrate.

9. The antenna of claim 1, wherein the ring element has a width of about 7 millimeters, and an outer diameter of about 48 millimeters.

10. The antenna of claim 1, wherein the ring element is located about 11 millimeters above the ground plane.

11. The antenna of claim 1, wherein the terrestrial element is a left hand circular polarized coil.

12. The antenna of claim 1, wherein the terrestrial element is a sleeve dipole.

13. The antenna of claim 1, wherein the terrestrial element is a rod.

14. The antenna of claim 1, wherein the terrestrial element is a helix.

15. The antenna of claim 1, wherein the radiator element is circular shaped.

16. The antenna of claim 1, wherein the radiator element has a diameter of about 40 millimeters.

17. The antenna of claim 1, wherein the ring element is circular shaped and the radiator element is circular shaped; and the ring element is located concentric with the radiator element.

18. The antenna of claim 1, wherein an input to the first low noise amplifier is coupled to a 90 degrees hybrid coupler coupled to a pair of feeds attached to the radiator element at 90 degrees to each other with respect to a center of the radiator element.

19. The antenna of claim 1, wherein an input to the first low noise amplifier is coupled to a 90 degrees hybrid coupler coupled to a four feeds attached to the radiator element at 90 degrees to each other with respect to a center of the radiator element.

20. The antenna of claim 1, further comprising a first conductor, coupled with a first low noise amplifier output of the first low noise amplifier; and a second conductor, coupled with a second low noise amplifier output of the second low noise amplifier;

the first conductor and the second conductor routed through an aperture in the base plate.

21. The antenna of claim 1, wherein the insulator is about at least 3 millimeters thick.

22. The antenna of claim 1, wherein the radiator element has an aperture located substantially at a center of the radiator element the terrestrial element located at the aperture, electrically isolated from the radiator element.

23. The antenna of claim 1, wherein a diameter, a width and a height dimension of the ring element are selected to create a higher order mode in the ring element.

24. The antenna of claim 1, wherein the cover is an encapsulation of the ring element, radiator element, insulator and printed circuit board.

* * * * *